United States Patent [19]

Wietelmann

[11] 4,167,968

[45] Sep. 18, 1979

[54] PRESSURE VESSEL

[75] Inventor: Friedrich Wietelmann, Heddesheim, Fed. Rep. of Germany

[73] Assignee: Babcock-Brown Boveri Reaktor GmbH, Mannheim, Fed. Rep. of Germany

[21] Appl. No.: 866,123

[22] Filed: Dec. 30, 1977

[51] Int. Cl.[2] ..... G05D 23/12

[52] U.S. Cl. ..... 165/32; 165/134 R; 176/38

[58] Field of Search ..... 165/32, 38, 134; 176/38; 137/574, 576

[56] References Cited

U.S. PATENT DOCUMENTS

| | | | |
|---|---|---|---|
| 3,289,744 | 12/1966 | Hosmer | 165/134 X |
| 3,398,789 | 8/1968 | Wolowodiuk | 165/134 |

OTHER PUBLICATIONS

*Power,* "Steam Generation", R. E. Wascher and G. J. Snyder, Apr. 1970, pp. 90 and 91.

*Primary Examiner*—Samuel Scott
*Assistant Examiner*—Margaret A. Focarino
*Attorney, Agent, or Firm*—Joseph M. Maguire; Edward A. Steen

[57] ABSTRACT

A heat exchanger including a pressure vessel and a plurality of heat exchanger tubes extending within the vessel. A tube shroud forms an annular passage between the tubes and the pressure vessel wall. A partition wall, comprising a plurality of openings normally closed by closure means, divides the passage into a fluid inlet compartment and a fluid outlet compartment. In the event the fluid pressure differential between the inlet and outlet compartments attains a predetermined value, at least some of the closure means will open to reduce the pressure differential below the predetermined value. In one embodiment of the invention, the closure means comprise flap valves. In an alternate embodiment of the invention, rupture discs are utilized as closure means.

10 Claims, 6 Drawing Figures

PRESSURE VESSEL

BACKGROUND OF THE INVENTION

1. Field of the Invention

This invention relates to pressurized heat exchangers and more specifically to an arrangement for relieving excessive pressure differentials within the heat exchanger in the event of a failure in the secondary coolant supply system.

2. Description of the Prior Art

The use of heat exchangers in conjunction with pressurized water reactors is well known. Typically, the heat exchanger takes the form of a vertically oriented elongated cylindrical pressure vessel containing a plurality of closely spaced tubes extending throughout the entire length of the vessel forming a tube bundle.

At both ends of the tube bundle a horizontally transposed tubesheet holds the tubes in position. A cylindrical tube shroud surrounds the tube bundle, and cooperates with the vessel wall to form an annular passage therebetween. A horizontally oriented partition wall circumscribes the tube shroud and divides the annular space into a fluid inlet compartment and fluid outlet compartment.

In this particular arrangement, a hot primary coolant enters the pressure vessel through an inlet nozzle, located at the base of the vessel, travels up through the tubes housed within the vessel, and exits through an outlet nozzle located at the head of the vessel. Simultaneously, secondary feedwater enters through a feedwater inlet nozzle, passes through the inlet compartment and is vaporized as it travels upwardly and around the tubes, and is then redirected downwardly through the fluid outlet compartment for discharge through the steam outlet nozzle.

During normal operating conditions, the shell side pressure may be in the order of 1085 psi. However, if either the secondary feedwater line or the main steam line should rupture, the pressure will quickly drop in the compartment connected with the ruptured line causing a large pressure differential across the two compartments. Such a pressure drop may cause extensive damage to the internal components of the vessel.

It is obvious that a reliable pressure equalization mechanism is therefore necessary to relieve the resulting pressure differential between the two compartments before serious damage occurs.

SUMMARY OF THE INVENTION

The present invention achieves pressure equalization in a pressurized heat exchanger in the event of a failure within either the main steam piping system or the secondary feedwater piping system.

In the main embodiment of the invention, there is provided a pressure vessel comprising a tube bundle. The tube bundle is surrounded by a cylindrical shroud forming an annular space with the vessel wall. The space is divided by a partition wall into a fluid inlet compartment and a fluid outlet compartment. The partition wall includes a plurality of openings; each being normally closed by a flap valve.

Each flap valve is made to open whenever the pressure differential between the inlet and outlet compartments attains a predetermined value, e.g., 140 psi. Selected valves will open depending on their orientation vis a vis the pressure differential. Some of the valves can only open into the fluid inlet compartment whereas the remaining valves can only open into the fluid outlet compartment. The valves which open into the inlet compartment are closed by resilient means whereas the valves which open into the outlet compartment gravitate to their normally closed position by virtue of their own weight. Of course, the latter valves may also be equipped with resilient means.

In an alternate embodiment of the invention, the fluid inlet and outlet compartments are connected by longitudinally situated ducts extending between two axially spaced annular plates comprising the partition wall. The ducts which serve as openings in the partition wall can either be closed by flap valves or rupture discs.

In a further embodiment of the invention, the flap valves are replaced by rupture discs designed to burst whenever the pressure differential exceeds the predetermined value.

DESCRIPTION OF THE PREFERRED EMBODIMENTS OF THE INVENTION

Figure 1:
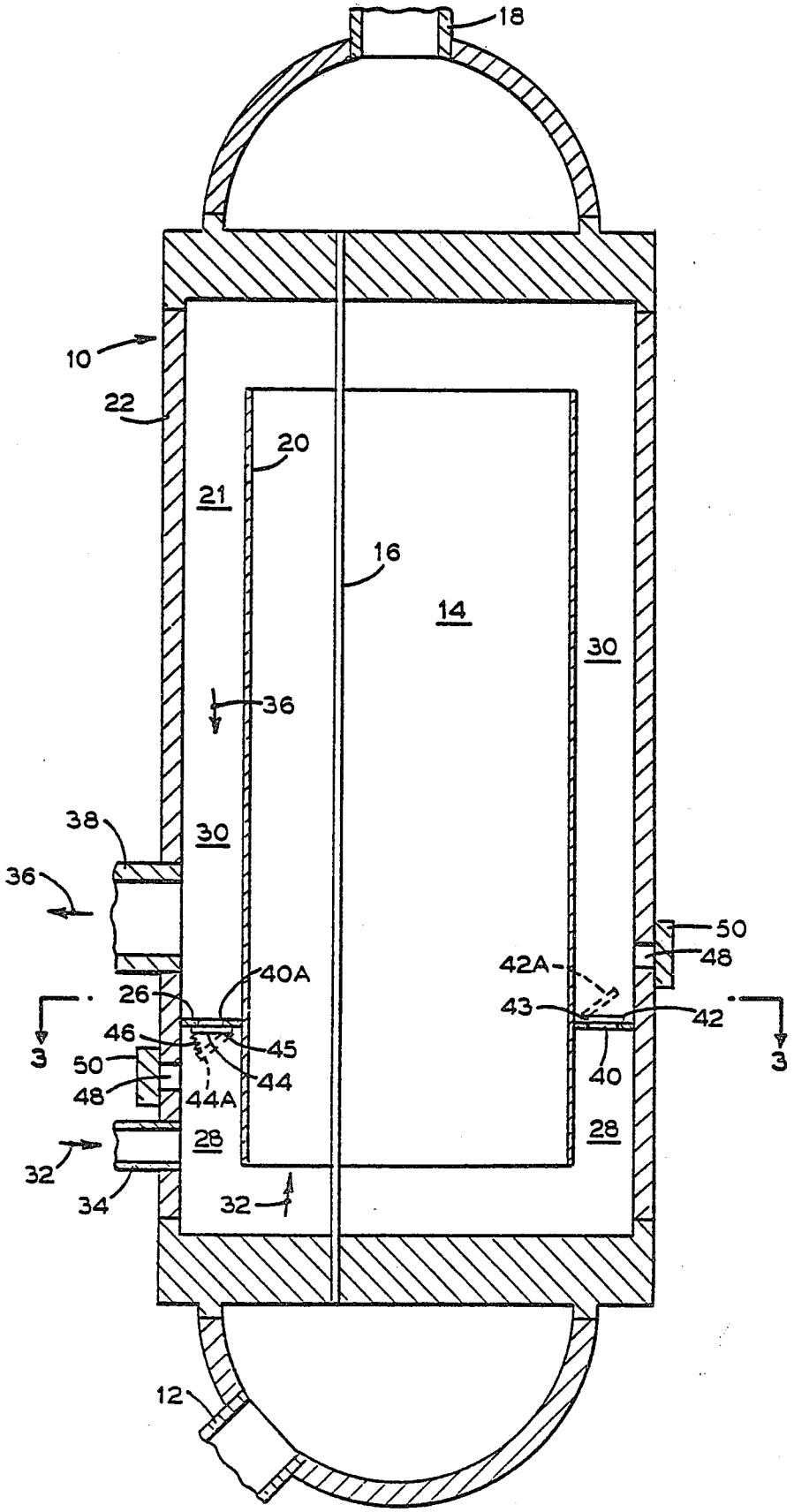
FIG. 1 is a cross sectional elevation of a pressure vessel embodying the invention.

FIG. 1 shows an upright pressure vessel 10. The primary coolant enters the vessel through inlet nozzle 12, flows through tubes 16, of which only one is depicted and exits through outlet nozzle 18. The tubes 16 are grouped to form a tube bundle 14, and the latter is surrounded by a cylindrical shroud 20 which cooperates with the vessel wall 22 to define an annular passage 21 therebetween. A partition wall 26 is disposed between the wall 22 and the shroud 20. The partition wall 26 is in the form of an annular plate circumscribing the shroud 20. As a result of this construction, the annular passage 21 is divided into a lower fluid inlet compartment 28 and an upper fluid outlet compartment 30. The feedwater enters the inlet compartment 28 through the feedwater inlet nozzle 34 as indicated by directional arrow 32. The water is vaporized as it passes up and around tube bundle 14 and leaves the outlet compartment 30 as indicated by directional arrow 36 through the main stream outlet nozzle 38 for delivery to a turbine, not shown.

The partition wall 26 contains a plurality of openings 40 and **40*a* which are normally closed by hinged flaps 42 and 44 of flap valves 43 and 45, respectively. The flaps 42 open into the fluid outlet compartment 30 as shown in dotted line at 42*a*, whereas flaps 44 open into the fluid inlet compartment 28 as shown in dotted line at 44*a***.

A tension spring 46 keeps each flap 44 closed. The flaps 42 do not require a tension spring since they will close of their own accord due to their weight. All of the valves 43 or 45 are designed to open whenever the pressure differential across compartments 28 and 30 attains a predetermined differential, e.g., 140 psi. Depending on the location of the pressure loss, flaps 44 will assume position **44*a* whereas flap 42 will assume position 42*a*. When the pressure differential falls below the predetermined value, all open valves will return to their normally closed positions. Handholes 48, which are normally sealed by plates 50, allow for periodic inspection of valves 43 and 45**.

Assuming that a rupture occurs in the feedwater piping system, not shown, the inlet compartment 28 will experience a large pressure loss thereby resulting in an excessive pressure differential between it and the outlet compartment 30. This condition will cause all of the flaps 44 to open to position 44*a*, as indicated in FIG. 1 thereby reducing the pressure differential between the inlet and outlet compartments 28 and 30. It should be recognized that flaps 42 will remain closed.

Assuming that a rupture occurs in the main steam piping system, not shown, the outlet compartment 30 will experience a large pressure loss thereby resulting in a differential between it and the inlet compartment 28. If this pressure differential attains the predetermined value, all of the flaps 42 will swing open to position 42*a*, reducing the pressure differential between the inlet and outlet compartments 28 and 30. It should be recognized that flaps 44 will remain closed.

Figure 2:
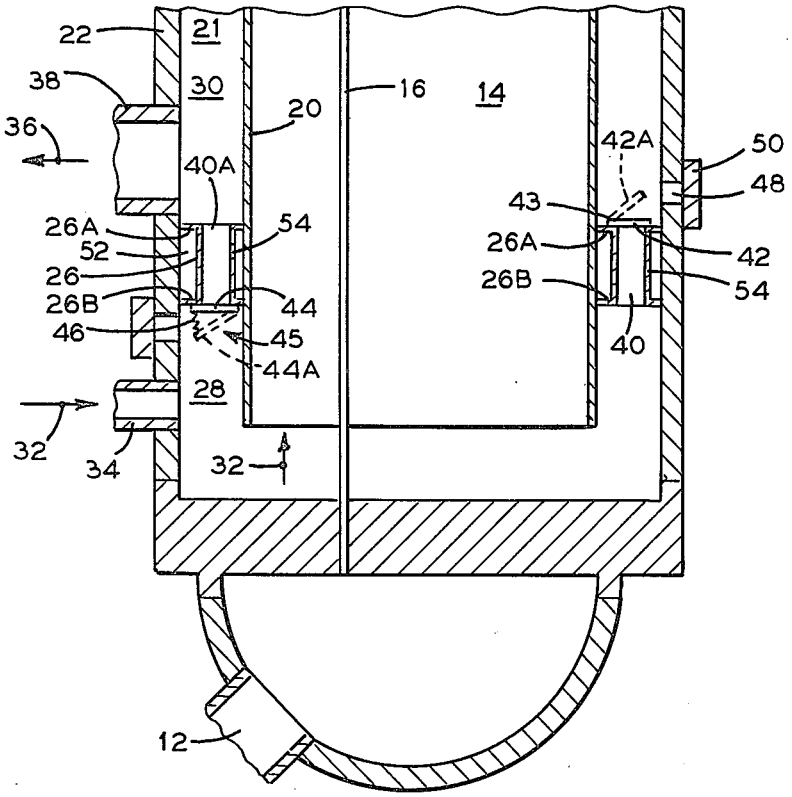
FIG. 2 is an alternate embodiment of the invention in partial cross sectional elevation.

According to an alternate embodiment of the invention, as shown in FIG. 2, the partition wall 26 is formed by two axially spaced annular plates 26*a* and 26*b* circumscribing the shroud 20 and defining an annular chamber 52. A plurality of ducts 54 extend between the annular plates 26*a* and 26*b* to form the openings 40 and 40*a* through partition wall 26. The interiors of ducts 54 which form the openings 40 and 40*a* are normally closed by hinged flaps 42 and 44 of flap valves 43 and 45.

Figure 3:
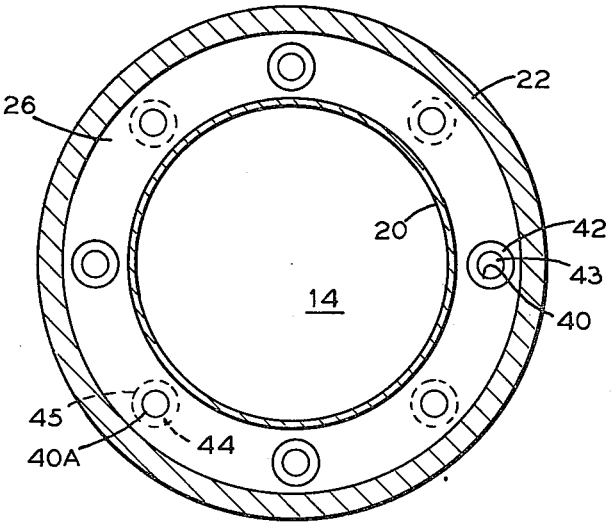
FIG. 3 is a cross sectional plan view taken along line 3—3 of FIG. 1.

FIG. 3 is a cross sectional plan view taken along line 3—3 in FIG. 1 showing the partition wall 26 disposed between the shroud 20 and the vessel wall 22. The partition wall includes alternately disposed openings 40 and 40*a* and the valves 43 and 45 with the flaps 42 and 44 in their closed position.

Figure 4:
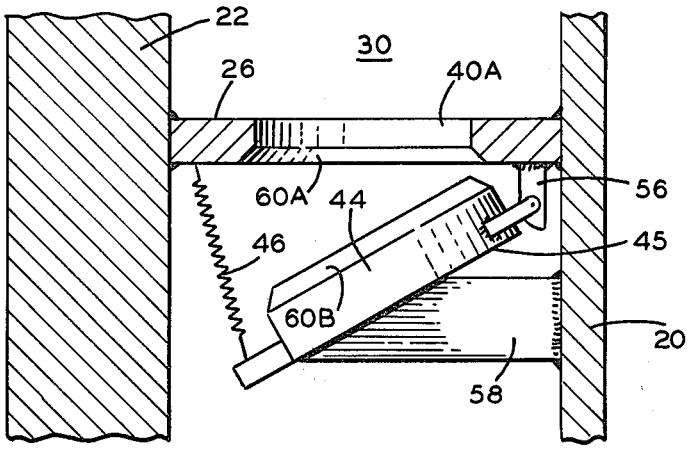
FIG. 4 is a detail view of an open flap valve.
Figure 5:
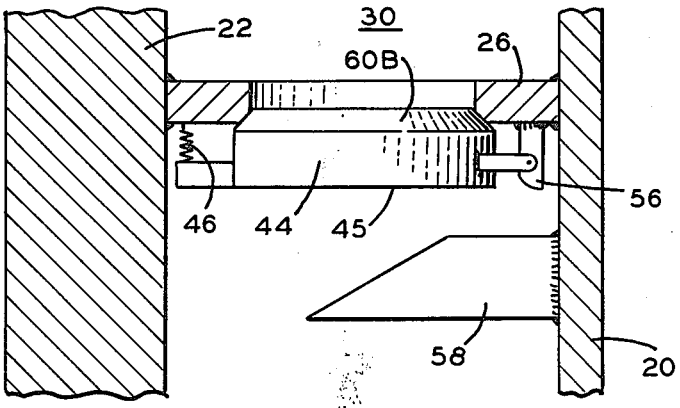
FIG. 5 is a detail view of a closed flap valve.

FIG. 4 shows opening 40*a* and flap valve 45 with its hinged flap 44 in the open position whereas FIG. 5 shows the flap 44 in its normally closed position. Both the opening 40*a* and the hinged flap 44 have beveled seating surfaces 60A and 60B, respectively, for tight seating. Flap 44 is hinged and supported from a support member 56 which is connected to the partition wall 26. In its fully open position, flap 44 will rest on a stop bar 58 which is connected to shroud 20. The spring 46 acts to close the flap 44 whenever the pressure differential between the inlet and outlet compartments 28 and 30 falls below the predetermined value and maintains the flap 44 in its closed position during normal operating conditions.

Figure 6:
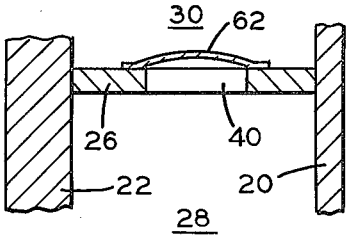
FIG. 6 shows a further embodiment of the invention.

FIG. 6 is directed to a further embodiment of the invention which employs rupture discs in lieu of flap valves and depicts one such disc 62 which is sized to cover the opening 40 or 40*a*, not shown, and is suitably attached to the partition wall 26. The disc 62 is designed to burst whenever the pressure differential between the inlet and outlet compartment 28 and 30 attains the predetermined value.

While in accordance with the provisions of the statutes there is illustrated and described herein a specific embodiment of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A heat exchanger comprising a pressure vessel, a plurality of heat exchanger tubes extending within the vessel, a shroud surrounding the tubes and cooperating with the vessel to form an annular passage therebetween, a partition wall dividing the passage into fluid inlet and outlet compartments, the wall having a plurality of openings extending therethrough, closure means normally closing the openings, and at least some of the closure means becoming open when the fluid pressure differential between said inlet and outlet compartments attains a predetermined value.

2. The heat exchanger according to claim 1 including the closure means comprising first and second flap valves.

3. The heat exchanger according to claim 2 including the first valves being disposed to swing open into the inlet compartment when the fluid pressure therein is below that of the upper compartment and the differential therebetween attains said predetermined value.

4. The heat exchanger according to claim 3 including resilient means for returning the first valves to their closed position when the fluid pressure differential falls below said predetermined value.

5. The heat exchanger according to claim 2 including the second valves being disposed to swing open into the outlet compartment when the fluid pressure therein is below that of the inlet compartment and the differential therebetween attains said predetermined value.

6. The heat exchanger according to claim 5 including the vessel being vertically oriented, the outlet compartment being located above the inlet compartment, and the second valves being disposed to gravitate to their closed position when the fluid pressure differential falls below said predetermined value.

7. The heat exchanger according to claim 2 including the first and second valves and said openings being formed with beveled seating surfaces.

8. The heat exchanger according to claim 2 including the first and second valves being alternately disposed along said partition wall.

9. The heat exchanger according to claim 1 including the closure means comprising rupture discs made to rupture when the fluid pressure differential attains and predetermined value.

10. The heat exchanger according to claim 1 including the partition wall comprising a pair of axially spaced annular plates, and having duct means extending between the plates to form the openings through said wall.

* * * * *